US010777341B2

(12) United States Patent
Levay et al.

(10) Patent No.: US 10,777,341 B2
(45) Date of Patent: Sep. 15, 2020

(54) POTENTIOMETER TOGGLE SWITCH

(71) Applicant: DENSO International America, Inc., Southfield, MI (US)

(72) Inventors: Christopher Ryan Levay, Grand Rapids, MI (US); Spenser Pawlik, Clarkston, MI (US); Javon Tucker, Southfield, MI (US); Murali Daruri, Troy, MI (US); Jesse Moellers, Royal Oak, MI (US); Yuki Matsumoto, West Bloomfield, MI (US)

(73) Assignee: DENSO INTERNATIONAL AMERICA, INC., Southfield, MI (US)

( * ) Notice: Subject to any disclaimer, the term of this patent is extended or adjusted under 35 U.S.C. 154(b) by 0 days.

(21) Appl. No.: 16/044,964

(22) Filed: Jul. 25, 2018

(65) Prior Publication Data

US 2020/0035389 A1 Jan. 30, 2020

(51) Int. Cl.

| | |
|---|---|
| ***H01C 10/36*** | (2006.01) |
| ***H01H 21/02*** | (2006.01) |
| ***H01C 10/50*** | (2006.01) |

(52) U.S. Cl.

CPC ..... *H01C 10/36* (2013.01); *H01C 10/50* (2013.01); *H01H 21/025* (2013.01)

(58) Field of Classification Search

CPC ..... H01C 10/36; H01C 10/50; H01C 21/025
USPC ..... 338/172
See application file for complete search history.

(56) References Cited

U.S. PATENT DOCUMENTS

| | | | | |
|---|---|---|---|---|
| 2,702,364 | A | 2/1955 | Rubinstein | |
| 2,863,030 | A | 12/1958 | Page | |
| 3,391,264 | A | 7/1968 | Stone | |
| 3,730,017 | A * | 5/1973 | Liddell | H01H 19/62 74/471 R |
| 3,978,457 | A | 8/1976 | Check, Jr. et al. | |
| 4,156,227 | A * | 5/1979 | Villar | H01C 10/36 338/172 |
| 4,649,527 | A | 3/1987 | Forster et al. | |
| 4,654,626 | A | 3/1987 | Carsello | |
| 4,689,547 | A | 8/1987 | Rowen et al. | |
| 4,742,508 | A | 5/1988 | Lee et al. | |
| 4,973,939 | A | 11/1990 | Lohner | |
| 5,262,678 | A * | 11/1993 | Flowers | H01H 3/0213 200/335 |
| 5,833,133 | A * | 11/1998 | Dage | B60H 1/00735 236/13 |

(Continued)

FOREIGN PATENT DOCUMENTS

| | | |
|---|---|---|
| GB | 474210 | 10/1937 |
| WO | 2009109508 A1 | 9/2009 |
| WO | 2017115172 A1 | 7/2017 |

*Primary Examiner* — Kyung S Lee
(74) *Attorney, Agent, or Firm* — Brooks Kushman P.C.

(57) ABSTRACT

A vehicle toggle switch includes a toggle button body configured to move and to correspond to a toggle up position or a toggle down position, the toggle up position corresponds to activation of a first vehicle function, and the toggle down position corresponds to activation of a second vehicle function, a mating portion of the toggle button body that includes an end, and a potentiometer connected to the end of the mating portion and is configured to rotate in response to the movement of the toggle button body and to output a voltage in response to the rotation of the potentiometer.

13 Claims, 6 Drawing Sheets

(56) References Cited

U.S. PATENT DOCUMENTS

| | | | | |
|---|---|---|---|---|
| 6,064,369 | A * | 5/2000 | Okabe | G05G 5/06 200/6 A |
| 6,259,351 | B1 | 7/2001 | Radosavljevic et al. | |
| 6,489,578 | B1 | 12/2002 | Jung et al. | |
| 6,591,175 | B2 * | 7/2003 | Numata | G05B 19/106 701/36 |
| 8,120,929 | B2 | 2/2012 | Becherer et al. | |
| 3,493,172 | A1 | 7/2013 | Pusateri et al. | |
| 8,485,059 | B2 * | 7/2013 | Peukert | F16H 59/02 74/473.12 |
| 2004/0113033 | A1 | 6/2004 | Johnson | |
| 2010/0295653 | A1 | 11/2010 | Pinto et al. | |
| 2011/0266119 | A1 | 11/2011 | Adams | |

* cited by examiner

POTENTIOMETER TOGGLE SWITCH

TECHNICAL FIELD

The present disclosure relates to a toggle switch for an automobile.

BACKGROUND

Toggle switches may be utilized as an interface for various components. Toggle switches may be utilized in vehicles to activate various vehicle functions, such as climate functions, audio functions, driver settings, etc. Toggle switches may need to meet packaging requirements for vehicle interiors. Additionally, toggle switches may need to be reliable when activated. For example, when the switch is activated, it must respond to the corresponding vehicle function. Furthermore, there may be requirements for keeping costs low or to meet other various requirements of the vehicle.

SUMMARY

According to one embodiment, a vehicle toggle switch includes a toggle button body configured to move and to correspond to a toggle up position or a toggle down position, the toggle up position corresponds to activation of a first vehicle function, and the toggle down position corresponds to activation of a second vehicle function, a mating portion of the toggle button body that includes an end, and a potentiometer connected to the end of the mating portion and is configured to rotate in response to the movement of the toggle button body and to output a voltage in response to the rotation of the potentiometer.

According to the second embodiment, a vehicle toggle switch includes a toggle button body configured to toggle up position, the toggle button body including a mating portion that includes an end, wherein the end is configured to connect with a gear configured to rotate in response to movement of the toggle button body, a potentiometer connected to the gear and configured to output a potentiometer voltage in response to the rotation of the gear, and a processor in communication with the potentiometer, wherein the processor is configured to output a first activation signal for a first vehicle function when the potentiometer voltage exceeds an upper threshold.

According to the third embodiment, a vehicle toggle switch comprises a toggle head configured to move up and down, a toggle button body configured to move in response to movement of the toggle head, a rotary encoder configured to rotate in response to movement of the toggle button body and to output a voltage in response to the rotation of the rotary encoder, and a processor in communication with the rotary encoder, the processor is configured to output an activation signal for a vehicle function when the voltage exceeds an upper threshold.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

A toggle switch with a low-cost structure that is capable of achieving a desirable haptic feeling and reliable activation may be desirable. Certain toggle switches may have a risk of mis-activation (early or late) due to the mechanical tolerance of the switch, thermal expansion, and a 2-way switch with only a binary on/off state. Other toggle switches (e.g. side-mounted dual-PCB designed) may minimize switch mis-activation, however, may have a higher-cost requirement because of requirement of two PCBs. A rocker switch design may also be useful to minimize mis-activation, however, require a larger packaging footprint in the "height direction" (H-direction e.g. 108 at FIG. 1). The utilization of a potentiometer sensor may allow for a reliable activation due to a variable resistance measurement with thresholds to detect activation. Variable resistance measurement may also be able to account for the mechanical tolerance and thermal expansion. A combination of calibration and software logic may be used to accurately determine a toggle event for a toggle switch. Furthermore, it may be desirable to achieve a smaller packaging footprint in the H-direction as compared to other toggle button designs.

Figure 1:
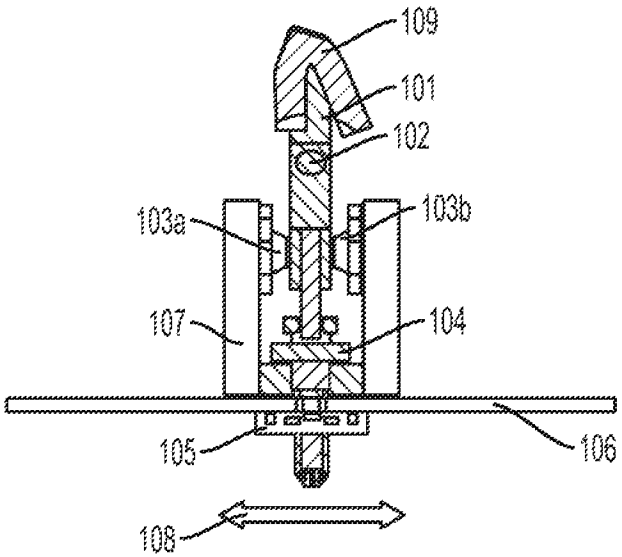
FIG. 1 discloses a side perspective view of an embodiment of the toggle switch.

FIG. 1 discloses a side perspective view of an embodiment of the toggle switch 100. The toggle switch 100 may include a toggle button cap 109 and a toggle button body 101 that is assembled to a front case 107. The toggle button body 101 may include a mating feature to an additional gear part 104. The gear part 104 may be relatively small. The gear part 104 may fit through a hole in the PCB 106 and mate with both the toggle button body and the potentiometer 105. A rubber switch mat dome 103*a*, 103*b* may be mounted perpendicular to the PCB on both sides on the toggle body.

The toggle body 101 may be constrained translationally and rotationally in two directions. The toggle body 101 may move (e.g. rotate) in one direction during a push event. As the toggle body 101 moves or rotates, it may push the gear 104, which causes the gear to rotate. During the rotation of the gear 104, the small gear may rotate the potentiometer and change the resistance value. In addition to rotating the gear 104, the toggle body 101 may also compress one of the rubber domes 103*a*, 103*b* to provide tactile feedback. A pivot 102 may be mounted onto the toggle button body 101. The pivot may be used to allow the toggle button body 101 to rotate upon a toggle up or toggle down movement.

A potentiometer 105 may be mounted to a printed circuit board (PCB) 106, for example, on a back-side of the PCB 106. The potentiometer 105 is configured change a resistance value as it rotates. Thus, when the resistance changes, the potentiometer voltage output varies in turn. The potentiometer 105 may be mounted flat to the PCB 106 and have a hole through its center with a ring that is allowed to rotate. A shaft fits to the ring through the center of the potentiometer. As the shaft rotates, the potentiometer ring rotates as well. The potentiometer rotation moves an internal contact point to change the resistance value of the sensor. An electronic control unit (ECU) may record the changing resistance value of the potentiometer and be used to determine if an activation event occurred. A combination of establishing resistance thresholds and a change in resistance over time may be used to identify toggle activation.

The toggle switch 100 may be utilized to activate any number of vehicle functions. For example, the toggle switch 100 may be utilized to activate functions related to climate control, such as temperature controls (e.g. temperature up or temperature down), fan speed (e.g fan speed up/fan speed down), air recirculation, air conditioning (A/C) mode, etc. The toggle switch 100 may also be utilized for various audio functions. For example, the toggle switch 100 may be utilized to seek up/seek down, tune up/tune down, volume up/volume down, search a track list, etc. The toggle switch 100 may also be utilized to control various multimedia displays (e.g. navigation display, dashboard display, etc.) in the vehicle cabin. In sum, the vehicle functionality of the toggle switch is not limited to any specific vehicle function.

The toggle switch 100 may be equipped with a first dome switch 103*a* and a second dome switch 103*b*. The first and second dome switches 103*a*, 103*b* may be utilized to provide a tactile feedback to a customer when a toggle up or toggle down action is conducted. The first and second dome 103*a*, 103*b* switch may be made of a plastic dome, silicon dome, metal dome, or any other suitable material. The first and second dome 103*a*, 103*b* may be depressed in response to a toggle up or toggle down movement, which in turn provides tactile feedback. A housing 107 feature of the toggle switch may be utilized to house various components of the toggle switch and to provide structural support for those components. The housing may be utilized to assemble multiple components together in a single-unit so that they can be simultaneously interacted in the vehicle.

The toggle switch with a potentiometer 105 may also reduce mis-activation based on thermal expansion. As thermal expansion occurs, the toggle switch may be capable of "re-zeroing" itself to adjust for some initial rotation of the potentiometer. While not shown in FIG. 1, a thermistor may also be utilized on the toggle switch 100. The thermistor may be utilized to detect a temperature of the environment surrounding the toggle switch. The thermistor may record a temperature and output it to an ECU (e.g. processor or microprocessor) of the toggle switch. The temperature data output by the thermistor may be utilized to automatically calibrate adjustment of activation commands of the toggle switch. Thus, when the toggle switch is in a cold or hot environment, the ECU may account for changes in contraction/expansion of the rubber dome and adjust activation sequences accordingly. There may also be displacement between the PCB, gear, and the toggle body mating end. A look-up table may be stored in memory and be in communication with an ECU of the PCB to quantify the expected expansion based on a temperature of the vehicle cabin or outside the vehicle cabin. The look-up table may be configured to determine a true nominal position based on the expected expansion in response to the vehicle temperature. The toggle switch 100 may also utilize a thermistor or thermometer from another vehicle system to gauge temperature readings. For example, the toggle switch 100 may be in communication with the HVAC system with a thermistor to measure the temperature of the cabin. In another embodiment, the vehicle may be equipped with a thermometer configured to measure the temperature outside of the vehicle.

Rather than utilizing a potentiometer, an encoder may be mounted in place of a potentiometer. The encoder may have two terminals that are used to acquire direction of the rotation. The encoder may have a certain angle of rotation is that required to activate the terminals in response to a toggle up or toggle down activation. For example, a 30° rotation may be required to activate an encoder in response to a toggle up or toggle down. Rather than utilizing a potentiometer, a rotary encoder may be mounted flat to a PCB. The rotary encoder may have a hole in its center that can rotate. A shaft may fit into the ring through the center of the rotary encoder. As the shaft rotates, the potentiometer ring of the PCB rotates as well. The encoder may have two sensors that are either on or off depending on where the center has rotated. The rotary encoder may either be an absolute encoder or incremental.

Figure 2:
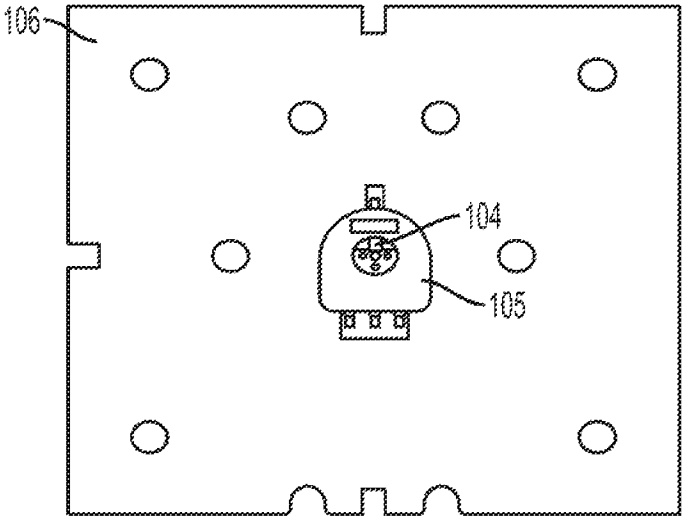
FIG. 2 discloses a bottom perspective view of an embodiment of the toggle switch.

FIG. 2 discloses a bottom perspective view of an embodiment of the toggle switch. As shown, the toggle switch may include a potentiometer 105 that is mounted below a PCB 106. A gear 104 may also fit through a hole of the PCB 106, such as a center hole. The gear 104 may mate with the toggle button body and the potentiometer 105. The gear 104 may be configured to react to movements of the toggle button body and in turn rotate the potentiometer 105.

Figure 3A:
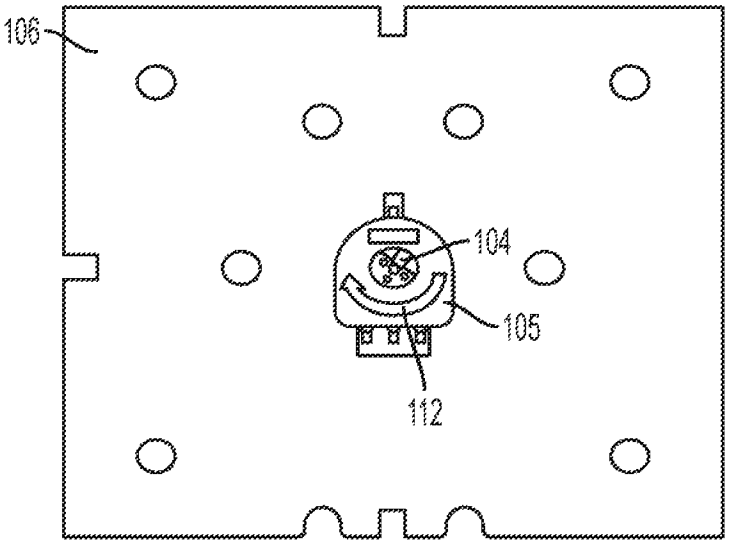
FIG. 3A discloses a bottom perspective view of an embodiment of the toggle switch being activated.
Figure 3:
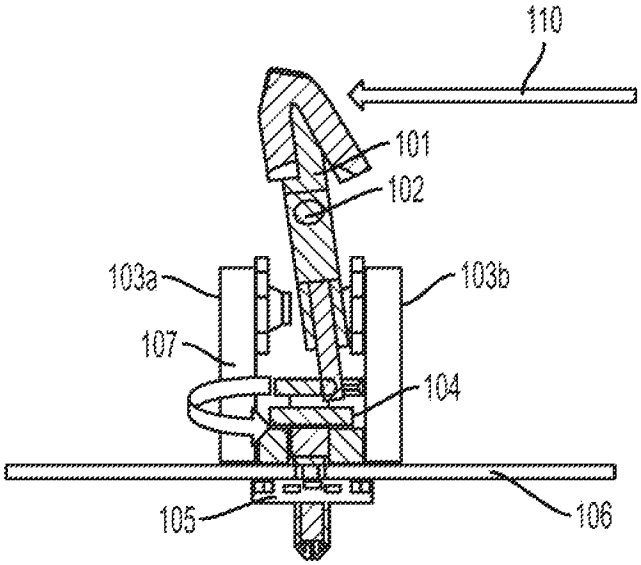
FIG. 3 discloses a side perspective view of an embodiment of the toggle switch being activated.

FIG. 3 discloses an example of a toggle switch being activated. As shown in FIG. 3, the toggle switch 100 may be pressed or moved by an orthogonal force 110 by an occupant of a vehicle. The orthogonal force 110 thus will force the toggle switch 100 to move. For example, if the orthogonal force 110 travels parallel from the right rubber mat dome 103*b* towards the left rubber mat dome 103*a*, movement of the toggle switch 100 occurs. In such a scenario, the toggle button cap 109 may move towards the left rubber mat dome 103*a*. However, the toggle button body 101 may move towards the right rubber mat dome 103*b*. The toggle switch 100 may move until the toggle button body 101 becomes in contact with the right rubber mat dome 103*b*. If the orthogonal force 110 travels in the opposite direction (e.g. from left rubber mat dome 103*a* towards right rubber mat tome 103*b*), the toggle button body 101 may move towards the left rubber mat dome 103*a* and the toggle switch will move toward the right rubber mat dome 103*b*. The pivot 102 may be mounted onto the toggle button body 101 that is used to allow the toggle button body 101 to rotate upon a toggle up or toggle down movement. The pivot 102 may be used to translationally constrain the toggle body and constrain rotation in two direction.

Once there is movement of the toggle switch 100, the mating feature of the toggle button body 101 may cause the gear 104 to rotate in either a clockwise or counter-clockwise direction by a certain angle. Because the toggle button body 101 is constrained translationally and rotationally in two directions, the toggle button body 101 may rotate in one dimension during a pushing event (e.g. around the pivot point 102). As the toggle button body 101 rotates, the body 101 pushes the small gear 104 that is configured to also rotate in response to the toggle button body. The gear 104 also rotates the potentiometer 105, which causes the resistance value of the potentiometer to change. In addition to the rotation of the gear 104, the toggle button body 101 also compresses one of the domes 103*a, b* to provide an appropriate tactile feedback to the customer. A housing 107 feature may be utilized to house various components of the toggle switch.

FIG. 3*a* discloses a bottom perspective view of an embodiment of the toggle switch being activated. As shown from the bottom perspective view, activation of the toggle switch 100 causes the gear 104 to rotate. The rotation of the gear 104 cause the potentiometer 105 to rotate. The potentiometer rotation 112 angle may be dependent on the rotation of the gear 104 as well as the type of mating feature utilized to connect the toggle button body 101 to the gear 104. The ECU of the PCB 106 may in turn monitor and record data values of the resistance change and voltage change/output in response to the potentiometer 105 rotating. The rotation 112 of the potentiometer 105 may be opposite (e.g. counter-clockwise) of that shown in FIG. 3A if the orthogonal force 110 is coming from the opposite direction to activate the toggle switch 100.

Figure 4:
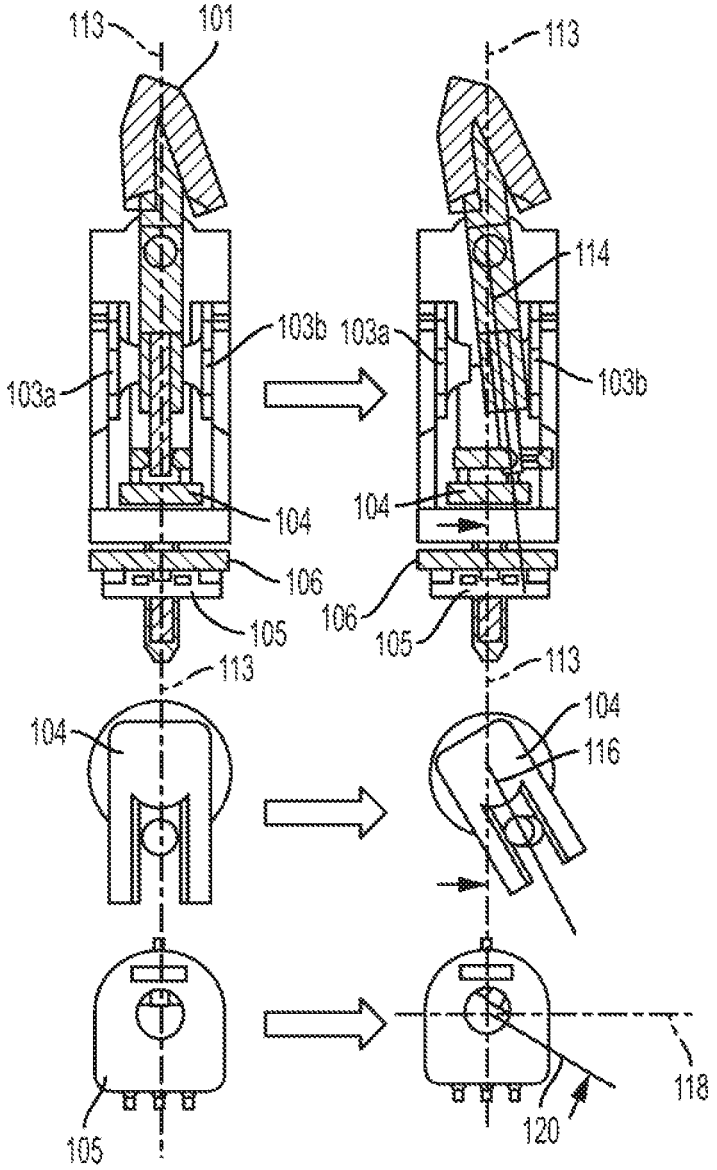
FIG. 4 discloses a side perspective view of an embodiment of the toggle switch, a top perspective view of the gear and potentiometer in a default state and in activation of the toggle switch.

FIG. 4 discloses a side perspective view of an embodiment of the toggle switch and a top perspective view of the gear and potentiometer in a both a default state and in activation of the toggle switch. An imaginary vertical axis 113 may be utilized in FIG. 4 to show movement of the toggle switch relative to various parts of the toggle switch 100. During a toggle push, a toggle body rotation may lead to some rotation of the potentiometer through the small gear. The change in the potentiometer angle may lead directly to a measurable change in the potentiometer resistance.

Figure 5:
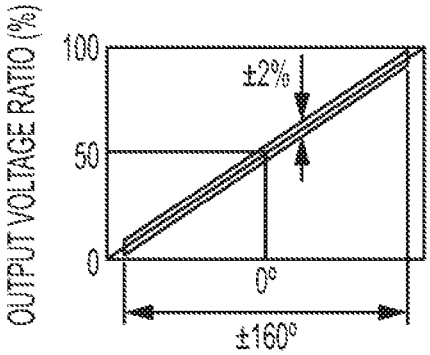
FIG. 5 discloses a graph of the potentiometer output voltage as compared to an activation angle of the potentiometer.

FIG. 5 is an example graph of the output voltage in response to rotation of the potentiometer. The Y-axis may be the output voltage ratio (%). The X-axis may be the degrees of rotation of the potentiometer with a range of +/−160°. The potentiometer may provide a continuous output in the form of a resistance change. The resistance change may be measured as a output potentiometer voltage. The potentiometer may provide continuous output which can be taken advantage of to avoid mis-activation concerns involved with the binary output a typical two-way switch. Such mis-activation may be realized due to mechanical tolerances or thermal expansions of various parts in the toggle switch. Thus, while a typical two-way switch either provides a "one" or "zero" output voltage for activation/non-activation, the toggle switch that includes a potentiometer may allow flexibility in determining a threshold voltage for activation of the switch. The flexibility of the potentiometer may be utilized to mitigate or eliminate mechanical tolerances. As shown on the graph, the index point may be 50% of the output voltage. There may also be an error tolerance of +/−2%. That is, for a given rotation of the potentiometer, a potentiometer's output may have some tolerance of +/−2%.

Figure 6:
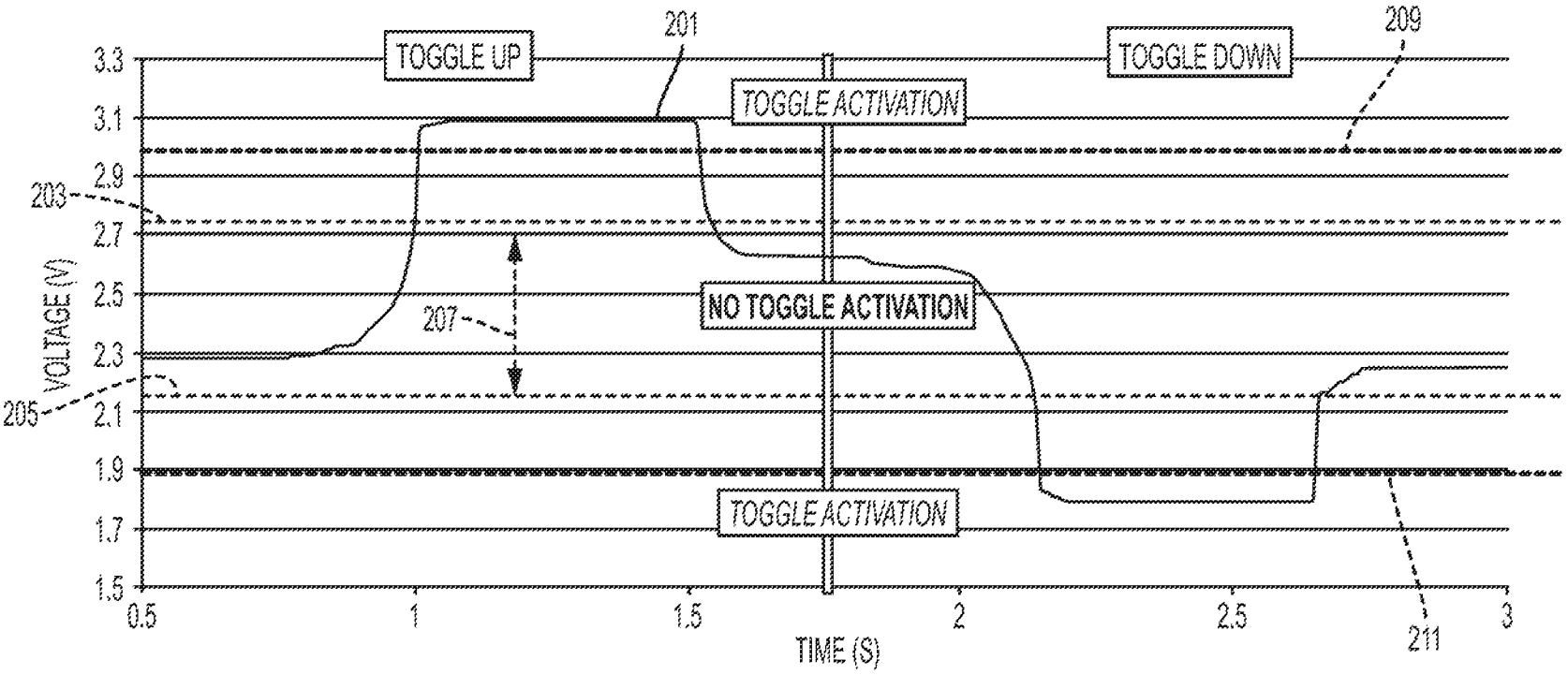
FIG. 6 discloses a graph of the potentiometer voltage as compared with time during a default state, toggle up, and toggle down of the toggle switch.

FIG. 6 is an example of a graph charting an output voltage in relationship to activation of a toggle switch. Along the y-axis of the graph of FIG. 6 is a voltage output of the potentiometer. Along the x-axis of the graph of FIG. 6 is a time in seconds. The potentiometer may include an output voltage 201 charted on the graph of FIG. 1. When there is no toggle activation, the potentiometer or toggle switch may be in a default state with no activation. During such a time, there still may be a resistance and voltage that is output by the potentiometer. A default range 207 of the potentiometer may be utilized to define an upper threshold 203 and lower threshold 205 for no toggle activation. As opposed to a standard binary switch, the range may allow for some tolerance in the event of mis-activations or rapid-pressing of the toggle switch to define such slight changes in the output voltage 201 as not being a toggle activation. The default range 207 may be set and stored by the ECU and memory associated with the ECU of the PCB of the toggle switch.

As shown in the graph of FIG. 6, there may be a first toggle activation threshold 209 that activates a vehicle function when the potentiometer outputs a voltage above the first toggle activation threshold 209. The first toggle activation threshold 209 may be above the upper default threshold 203. When the output voltage 201 exceeds the first toggle activation threshold 209, the ECU of the PCB may responsively activate a vehicle function associated with the toggle switch. The first toggle activation threshold 209 may be in response to the toggle switch moving either up or down, and in turn rotating the potentiometer clockwise or counterclockwise to increase the voltage output. In one scenario, a user may hold up the toggle switch which in turns allows the potentiometer to output a max voltage at a constant rate over time. The ECU of the PCB may associate a voltage above the toggle activation threshold 209 with a vehicle function. For example, when the voltage above the toggle activation threshold 209 is output, the ECU may identify an action to increase a temperature of the vehicle's heating, ventilation, and air conditioning (HVAC) system.

As shown in the graph of FIG. 6, there may be a second toggle activation threshold 211 that activates a vehicle function when the potentiometer outputs a voltage below the second toggle activation threshold 211. The second toggle activation threshold 211 may be below the lower default threshold 205. When the output voltage 201 is below the second toggle activation threshold 211, the ECU of the PCB may responsively activate a vehicle function associated with the toggle switch. The second toggle activation threshold 211 may be in response to the toggle switch moving either up or down, and in turn rotating the potentiometer clockwise or counterclockwise to decrease the voltage output. In one scenario, a user may hold down on the toggle switch which in turns allows the potentiometer to output a minimum voltage at a constant rate over time. The ECU of the PCB may associate a voltage below the toggle activation threshold 211 with a vehicle function. For example, when the voltage below the toggle activation threshold 211 is output, the ECU may identify an action to decrease a temperature of the vehicle's HVAC system.

There may also be a range between the upper default threshold 203 and the first toggle activation threshold 209 that will also lead to activation of a first vehicle function. There may also be a range between the lower default threshold and the second activation threshold that will also lead to activation of a second vehicle function. In some embodiments, the upper default threshold 203 and the first activation threshold 209 may be the same voltage. In another embodiment, the lower default threshold 203 and the second activation threshold 209 may be the same voltage.

When the toggle switch is originally installed, a calibration may be run to determine a nominal reading of the toggle switch. When the toggle switch is first pressed up, an upper target point for activation may be set. The toggle may be pressed down to set the lower target point for activation. This may account for any tolerance deviation which causes the potentiometer to start outside of its nominal position. The calibration may be done automatically or manually. Software may be utilized that allows a customer or dealership to make adjustments utilizing a human-machine interface (HMI) of the vehicle. Such adjustments may be made based on the owner's environment of the vehicle. Such considerations may include the climate, season, altitude, or etc. of the vehicle. Each of the considerations may affect the thermal expansion and mechanical tolerances of the toggle switch.

The toggle switch may also reduce mis-activation based on velocity recognition of the toggle switch with a potentiometer. Because the recognition of activation is not binary, velocity recognition may be utilized for switch activation. During a toggle stroke, the resistance of the potentiometer may change at a greater rate during the rubber dome snap down event. This increased change in slope may be recognized through software and used to determine activation. In another example, a range can float at various areas of activation threshold to be dependent on the environment of the vehicle.

The potentiometer or the processor in communication with the potentiometer may be constantly recording the voltage for monitoring. The data of the potentiometer voltage that is output may provide indications of habits that occur over time. For example, a large slope up of the potentiometer voltage can be correlated to a toggle up position. In another example, a large slope down of the potentiometer voltage can be correlated to a toggle down position.

Figure 7C:
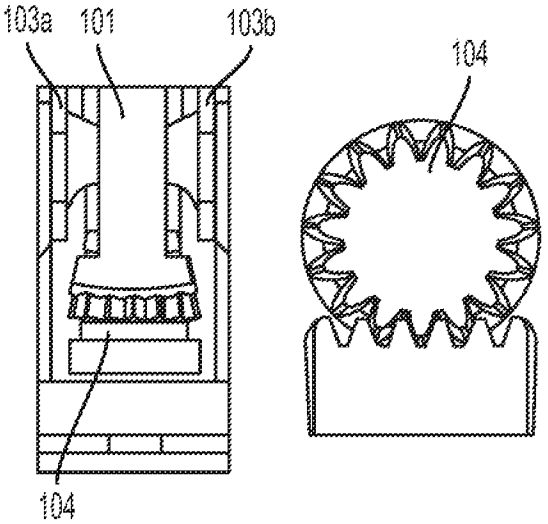
FIG. 7C discloses an example of a bevel gear of one embodiment of the toggle switch.
Figure 7B:
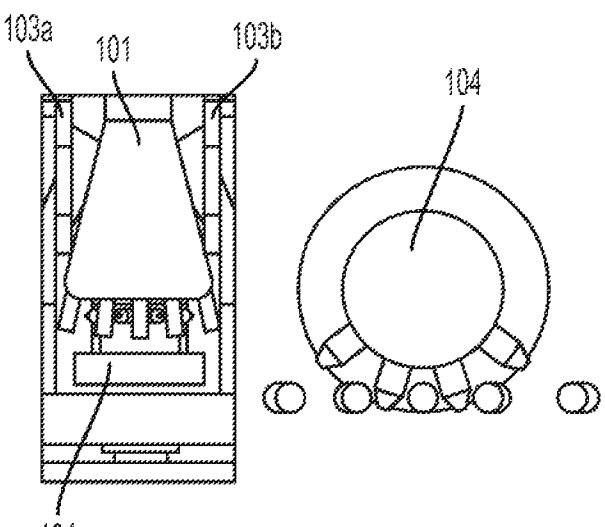
FIG. 7B discloses an example of a spoke gear of one embodiment of the toggle switch.
Figure 7A:
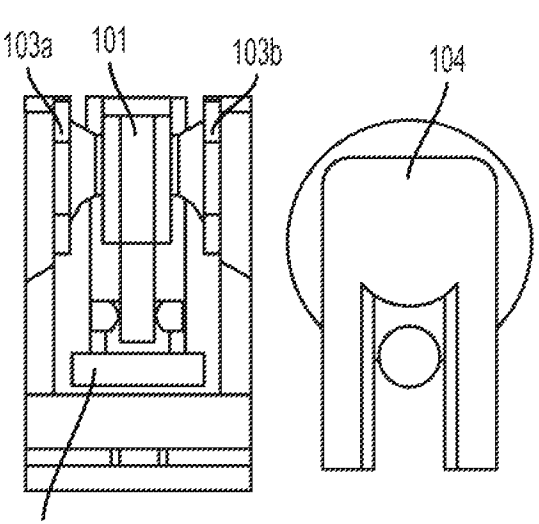
FIG. 7A discloses an example of a flagpole gear of one embodiment of the toggle switch.

FIG. 7A discloses an example of a flagpole gear of one embodiment of the toggle switch. As explained above, a gear 104 may be utilized to connect the potentiometer to the mating feature of the toggle switch. The gear 104 may be any type of gear utilized. Different mating shapes can be used to maximize the amount of potentiometer rotation. The larger the potentiometer rotation, the larger the change in resistance. The larger change in resistance may allow the software of the ECU to check for a toggle push. For example, 4° is an approximate nominal toggle push rotation based on a position of the left rubber dome 103*a* and right rubber dome 103*b*. A flagpole gear is one type of gear 104 that may be utilized. In one example, the flagpole gear may have a toggle rotation angle (θ) at 4°. In response to the toggle rotation of the gear 104, the potentiometer may have a potentiometer rotation (α) of 20°. As the potentiometer rotation α increases towards the 20° angle, the voltage output by the potentiometer may increase more dramatically based on the potentiometer's resistance change.

FIG. 7B discloses an example of a spoke gear of one embodiment of the toggle switch. The spoke gear may require a different mating feature of the toggle button body. For example, a spoke gear may require the mating feature to have one or more plurality of arms to rotate the gear. As shown in FIG. 7B, the mating feature of the toggle button body may have 5 arms. The spoke gear may allow for a larger potentiometer rotation than a flagpole gear shown in FIG. 7A. In one example, the spoke gear may have a toggle rotation angle θ at 4°. In response to the toggle rotation of the gear 104, the potentiometer may have a potentiometer rotation α of 21.7°. As the potentiometer rotation α increases towards the 21.7° angle, the voltage output by the potentiometer may increase or decrease more dramatically based on the potentiometer's resistance change.

FIG. 7C discloses an example of a bevel gear of one embodiment of the toggle switch. The bevel gear may require a different mating feature of the toggle button body. For example, a bevel gear may require the mating feature to have one or more plurality of teeth within the gear to rotate and to interlock with the gear's corresponding grooves. The bevel gear shown in FIG. 7C may have a ratio of 6:1. As shown in FIG. 7C, the mating feature of the toggle button body may have a pair of interlocking gears. The bevel gear may allow for a larger potentiometer rotation than a flagpole gear shown in FIG. 7A. In one example, the spoke gear may have a toggle rotation angle θ at 4°. In response to the toggle rotation of the gear 104, the potentiometer may have a potentiometer rotation α of 24°. As the potentiometer rotation α increases towards the 24° angle, the voltage output by the potentiometer may increase or decrease more dramatically based on the potentiometer's resistance change.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life-cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A vehicle toggle switch, comprising:

a toggle button body configured to maneuver in a toggle up position, the toggle button body including a proximal end and a distal end at opposite ends and running along a length of a vertical axis, wherein the distal end includes a mating portion that is configured to connect with a gear configured to rotate in response to movement of the toggle button body, and wherein proximal end is connected to a toggle button cap;

a potentiometer connected to the gear and configured to output a potentiometer voltage in response to the rotation of the gear; and a processor in communication with the potentiometer, wherein the processor is configured to output a first activation signal for a first vehicle function when the potentiometer voltage exceeds an upper threshold.

2. The vehicle toggle switch of claim 1, wherein the processor is configured to output a second activation signal for a second vehicle function when the potentiometer voltage drops below a lower threshold.

3. The vehicle toggle switch of claim 2, wherein the processor is in a default state when the potentiometer voltage is between the upper threshold and lower threshold, and the default state does not output any activation signals.

4. The vehicle toggle switch of claim 1, wherein the processor is further configured to deactivate the first activation signal when the potentiometer voltage drops below the upper threshold.

5. The vehicle toggle switch of claim 4, wherein the processor is configured to determine a temperature of the toggle switch.

6. The vehicle toggle switch of claim 5, wherein the processor is configured to adjust the upper threshold and the lower threshold in response to the temperature.

7. The toggle switch of claim 6, wherein the processor is configured to adjust the upper threshold and the lower threshold utilizing a look-up table stored on memory in communication with the processor.

8. The vehicle toggle switch of claim 1, wherein the potentiometer is part of a rotary encoder.

9. The vehicle toggle switch of claim 1, wherein the toggle button body is configured to rotate.

10. The vehicle toggle switch of claim 1, wherein a first rubber dome and a second rubber dome along opposite sides of the toggle button body.

11. The vehicle toggle switch of claim 10, wherein the toggle button body is configured to contact the first rubber dome, but not the second rubber dome, when the toggle button body is in the toggle up position.

12. The vehicle toggle switch of claim 10, wherein the first rubber dome configured to provide tactile feedback in response to the toggle up position; and the second rubber dome configured to provide tactile feedback in response to a toggle down position.

13. A vehicle toggle switch, comprising:

a toggle head configured to move up and down;

a toggle button body configured to move in response to movement of the toggle head, wherein the toggle button body includes a proximal end and a distal end at opposite ends and running along a length of a vertical axis, wherein the distal end includes a mating portion that is configured to connect with a rotary encoder configured to rotate in response to movement of the toggle button body and to output a voltage in response to the rotation of the rotary encoder; and a processor in communication with the rotary encoder, the processor is configured to output an activation signal for a vehicle function when the voltage exceeds an upper threshold.

* * * * *